US006075496A

United States Patent [19]

Harriman

[11] Patent Number: 6,075,496

[45] **Date of Patent: *Jun. 13, 2000**

[54] SHUNT FEED ANTENNA FOR LARGE TERRESTRIAL VEHICLES

[75] Inventor: Adam Harriman, Indialantic, Fla.

[73] Assignee: Flash Comm, Inc., Melbourne, Fla.

[ * ] Notice: This patent issued on a continued prosecution application filed under 37 CFR 1.53(d), and is subject to the twenty year patent term provisions of 35 U.S.C. 154(a)(2).

[21] Appl. No.: 08/784,817

[22] Filed: Jan. 16, 1997

[51] Int. Cl.[7] ..... H01Q 9/16

[52] U.S. Cl. ..... 343/821; 343/713

[58] Field of Search ..... 343/821, 793, 343/820, 822, 700 MS, 767, 846, 713; H01Q 9/16

[56] References Cited

U.S. PATENT DOCUMENTS

| | | | |
|---|---|---|---|
| 3,961,323 | 6/1976 | Hartkon | 340/280 |
| 4,023,179 | 5/1977 | Ikrath et al. | 343/767 |
| 4,185,289 | 1/1980 | Desantis et al. | 343/770 |
| 4,316,194 | 2/1982 | Santis et al. | 343/700 MS |
| 4,317,121 | 2/1982 | Allen, Jr. et al. | 343/712 |
| 5,229,777 | 7/1993 | Doyle | 343/846 |

FOREIGN PATENT DOCUMENTS

| | | |
|---|---|---|
| 0390290 A1 | 3/1990 | European Pat. Off. . |
| 195 48 206 A1 | 6/1997 | Germany . |

OTHER PUBLICATIONS

The ARRL Antenna Book, 17th Edition, 1994 pp. 26–18, 26–19.

*Primary Examiner*—Don Wong
*Assistant Examiner*—Tho Phan
*Attorney, Agent, or Firm*—Hamilton, Brook, Smith & Reynolds, P.C.

[57] ABSTRACT

An antenna for use with a shippinconductive elements shunt fed to an exterior metallic surface of the container. As a result, electromagnetic field energy is radiated or detected by coupling to currents flowing in the surface of the container, rather than by direct coupling to the radio waves themselves. The shunt fed antenna forms a feed system for the mobile structure. It performs best when mounted on a lower plane of the container adjacent a vertical side, but may be mounted on the vertical side itself in applications where the containers are intended to be stacked upon one another or where vertical polarization properties are desired.

9 Claims, 7 Drawing Sheets

SHUNT FEED ANTENNA FOR LARGE TERRESTRIAL VEHICLES

FIELD OF THE INVENTION

The present invention relates generally to antennas, and in particular to an antenna adapted for use with radio equipment mounted on or near metallic containers or vehicles.

BACKGROUND OF THE INVENTION

The application of wireless communication technology to centralized distribution of information increasingly demands that radio equipment such as transceivers and antennas be specifically adapted to the particular end use. In one application of wireless technology to cargo tracking systems, two-way paging systems are used for sending and receiving digital signals at low data rates to and from individual cargo containers. The two-way paging network may use satellite and/or terrestrial radio links to communicate with miniature paging transceivers located in each container.

Such paging equipment may operate in the High Frequency (HF) and/or Very High Frequency (VHF) radio band. At those frequencies, most antennas are of the monopole or so-called whip type and are electrically short, being of a physical length of one-quarter wave length or less. For example, whips intended to operate in the HF band are typically of a length of approximately 96 inches or more.

Unfortunately, whip antennas are not convenient for adaptation to most types of cargo containers directly. This is true for several reasons. The containers may be of the type adapted for use as a trailer for a truck, a railway boxcar, or a shipping container adapted for cargo ships which is to be stacked in a shipyard and moved via trailers and/or railway cars.

When such containers are mounted on trailers or trucks, for example, state and Federal highway regulations typically require clearance for bridges and underpasses to be thirteen feet and six inches (13'6"). Many trailers already are designed to be of a maximum safe clearance height such that there is close tolerance on the clearance. It is therefore not practical to attach an additional 30" vertical whip antenna.

In other applications, it is desirable to stack containers such as in a shipyard or on a cargo ship. It is not practical in those instances for antennas to be protruding from the sides, upper or lower surfaces of the containers, as they would therefore be deformed or damaged.

What is needed is an antenna for use with metallic containers and other large terrestrial vehicles that avoids these difficulties.

SUMMARY OF THE INVENTION

The invention is a shunt feed antenna intended to be used for a metallic or metal framed shipping container or other large terrestrial vehicle such as a trailer or railway boxcar. Rather than acting by itself as the radiator, such as might typically occur with conventional monopole antennas, the shunt feed arrangement provides for coupling to electromagnetic currents flowing or induced on the metallic container surface. The exciter thus acts together with the container as the radiating device.

More particularly, the antenna is physically a pair of conductive elements disposed end to end. The adjacent ends of the conductive elements are connected to the primary winding of an isolating device such as a balun. The distal ends of the conductors are shunted to the container surface. A signal lead from the transceiver equipment is connected to the secondary winding of the balun.

In instances where vertical clearance above the contained is critical, such as for a truck trailer, the shunt feed antenna is mounted on a lower plane of the container near a vertical side of the container, with the major axis of the antenna elements oriented with the major axis of the container. This is the preferred arrangement, where the incoming radio signal is essentially horizontally polarized, and it is critical to maintain maximum clearance above the container.

In other types of vehicles, such as a beverage truck, there may be minimal clearance beneath the container, in which case the antenna may be mounted on top.

The antenna may also be used in a vertical orientation. In this arrangement, the antenna is for example, mounted parallel to the typical corrugations on the side of a container. This is the preferred arrangement when the container is intended to be stacked upon other containers, such as used in a shipyard.

In antenna intended for High Frequency (HF) radio band operation, the element lengths total approximately seven feet. In addition, the elements are preferably disposed beneath the container approximately six inches from the lower container surface.

The antenna may be constructed in a structurally rigid form. In a preferred embodiment, the radiating elements are formed from a copper tape. The copper tape is then disposed in a non-conductive housing, formed from plastic, fiberglass or other conveniently rigid material. The housing may then be further filled with non-conductive foam above or below the conductive tape to ensure structural integrity.

BRIEF DESCRIPTION OF THE DRAWINGS

The above and further advantages of the invention may be understood by referring to the following description in conjunction with the accompanying drawings, in which.

DETAILED DESCRIPTION OF A PREFERRED EMBODIMENT

Figure 1:
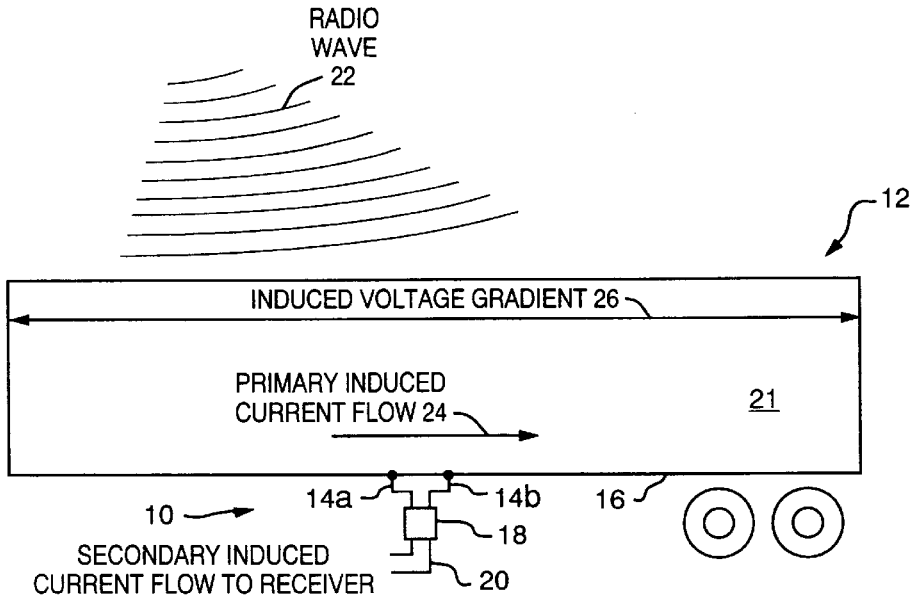
FIG. 1 is a diagrammatic view of a container, such as a truck trailer, showing a horizontally oriented implementation of a shunt fed antenna according to the invention.

Turning attention now to FIG. 1, there is shown a diagrammatic view of an antenna 10 for use with a metallic container 12 according to the invention. The container 12 may be of the type used as a truck trailer, railway boxcar, or may be a stackable container of the type used with cargo ships. The container 12 may also be the body of some other type of large terrestrial vehicle having planar sides.

The antenna 10 includes a first conductive element 14*a* and a second conductive element 14*b*. The first and second generally along a common axis. The adjacent ends of the conductive elements 14 are connected to the primary winding of a balun 18. The distal ends of the conductive elements 14 are directly shunted to the surface of the container 12 to provide electrical contact thereto.

A cable 20 provides connection to and from a radio transceiver (not shown). The cable 20 is connected to the secondary side of the balun 18. The transceiver equipment is typically mounted elsewhere in or on the container in a manner which does not interfere with the antenna 10 or the operation of the container 12 or the vehicle on which the container is loaded.

The antenna 10 is typically disposed along the lower planar surface 16 of the container 12. By so disposing the antenna 10 along the lower surface 16, the antenna 10 does not protrude above the container 12 or otherwise interfere with highway overpasses or bridges or the like.

The manner in which the antenna 10 operates as an electromagnetic radiator, that is, as a transmit antenna, will now be described. It should be understood, however, that the principle of reciprocity applies, and that the antenna 10 may be used as a receiving antenna as well.

In operation, the shunt feed induces a current flow and voltage gradient along the surface of the container 12, as indicated by the arrows 24 and 26 respectively. As previously mentioned, the antenna 10 thus does not act by itself to directly radiate electromagnetic energy. Rather, the shunt feed arrangement provides coupling of electromagnetic energy to the surface of the container 12. It is these induced currents which in turn produce the radio wave 22.

Figure 2:
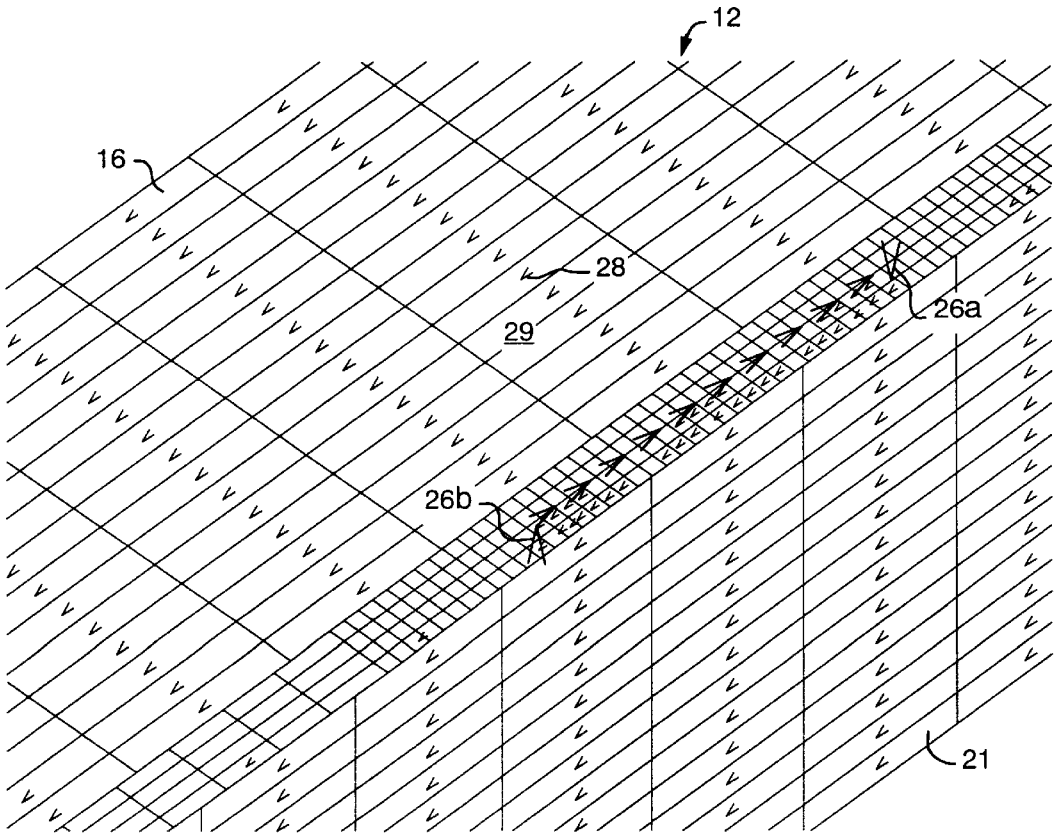
FIG. 2 is a plot taken from an element modeling software program, showing how the shut fed antenna induces currents in the adjacent surfaces of the container.

FIG. 2 is a detailed illustration of the non-radiating complex currents induced in the surfaces of the container 12. The view of FIG. 2 is taken from underneath the container 12, such that the container 12 is shown upside down with respect to the orientation in FIG. 1. The lower surface 16 thus appears in the upper portion of the diagram and the side of the trailer 21 appears in the front of FIG. 2. The points 26*a* and 26*b* correspond to the feed points at which the distal ends of conductive elements 14*a* and 14*b*, respectively, are contacted to the surface of the container 12.

The illustration of FIG. 2 was created by constructing a mathematical model of the container 12 in an element modeling software package such as the Numerical Electromagnetics Code 4 (NEC-4) software. NEC-4 uses a method-of-moments type modeling and is available from the Lawrence Livermore National Laboratory in Livermore, Calif.

The computer model illustrates that the shunt feed arrangement induces real currents in a closed loop region about the points 26*a* and 26*b*, which in turn cause the surface of the container 12 to radiate. The arrows 28 indicate induced current flow in corresponding sections 29 of the container 12. The larger the arrow 28, the greater the induced current flow. In essence, as indicated by the arrows 28, the container 12 becomes part of a wire loop.

Figure 3:
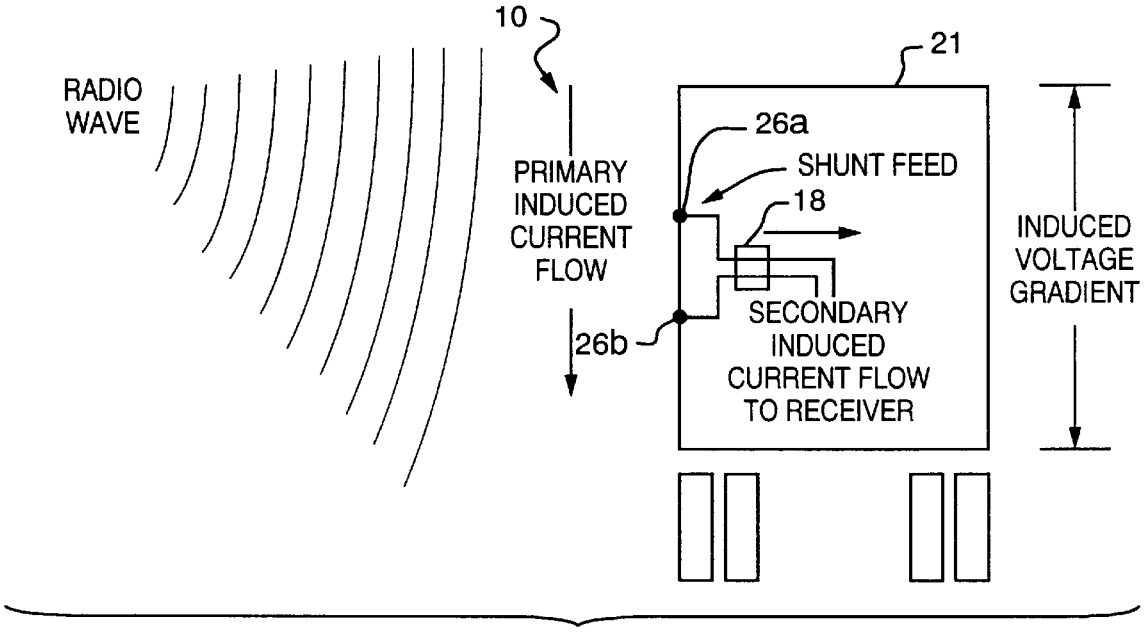
FIG. 3 is a diagrammatic view of a container, such as a truck trailer, showing a vertically oriented implementation of a shunt fed antenna according to the invention.

FIG. 3 shows an alternate arrangement of the antenna 10 when it is preferred that the currents induced on the container 12 produce a vertically polarized radio wave. In this instance, the antenna 10 is vertically oriented, and the shunt feed contact points 26*a* and 26*b* can be on the side 21 of the container 12.

Figure 4:
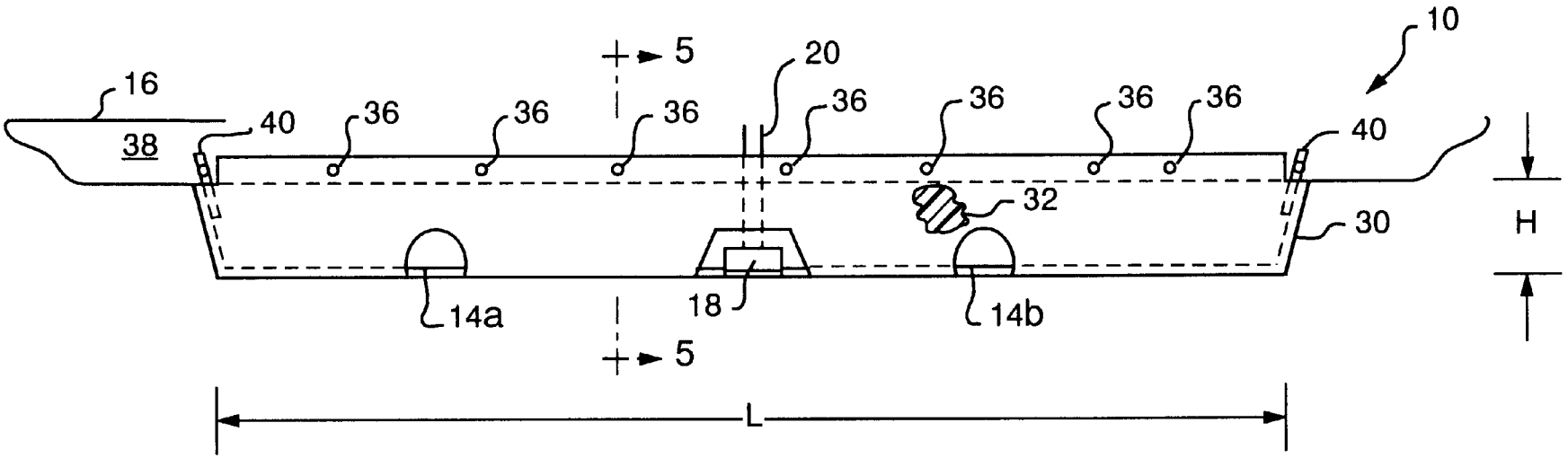
FIG. 4 is a partially cutaway side view of one possible embodiment of the antenna of FIG. 1.

FIG. 4 is a partially cutaway side view of a preferred implementation for the antenna 10. The conductors 14*a* and 14*b* are implemented, as shown in the cutaway portions, as a conductive strip of material such as a piece of copper tape. The copper tape is disposed in the lower portion of a housing or enclosure 30 which is itself made out of a non-conductive material. The portion of the enclosure 30 above or below the elements 14*a* and 14*b* may be filled with a non-conductive material 32 such as polyethylene foam to provide rigidity to the antenna 10. The balun 18 and cables 20 are essentially disposed in the center of the antenna 10.

The total length of the conductive elements 14*a* and 14*b*, as indicated by the arrows 1 in FIG. 4, is preferably approximately 7' in the case of an antenna that is expected to operate in the High Frequency (HF) radio band. The enclosure 30 contains a lip 34 within which are formed mounting holes 36 so that the antenna 10 can be easily mounted to the lower portion of a truck trailer such as along a beam 38 formed in the lower surface 16 of the trailer.

Figure 5:
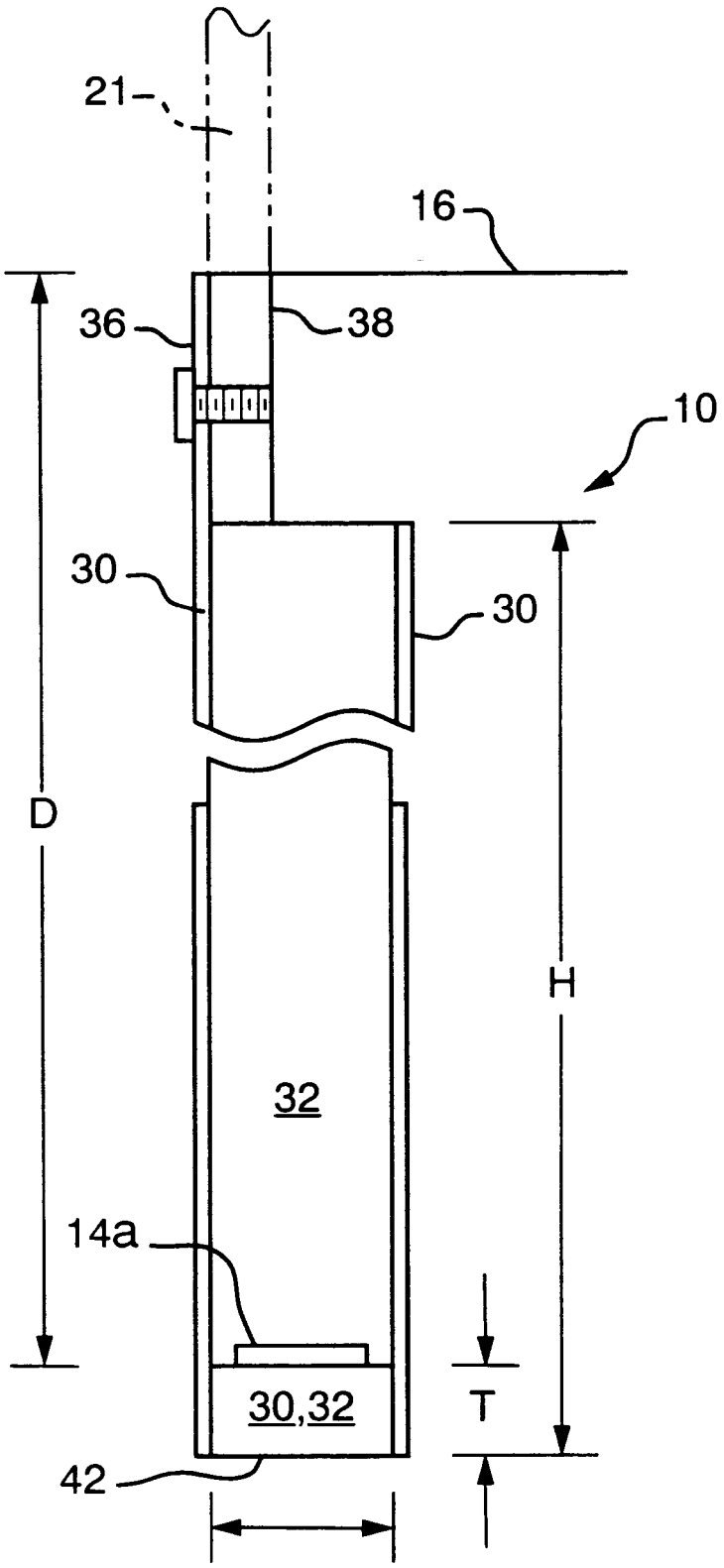
FIG. 5 is a detailed cross-sectional view taken along lines 5—5 of FIG. 4.

FIG. 5 is a detailed cross-sectional view taken along lines 5—5 of FIG. 4.

The ends of the enclosure 30 may be tapered as shown to provide additional mounting brackets 40 and/or additional structural rigidity as required.

The distance T from the conductive element 14*a* and the bottom 42 of the container 30 is chosen such that the distance D from the lower surface 16 of the container 12 to the conductive elements 14*a* and 14*b* is approximately 6" in the case of HF operation.

The bottom portion 42 of the enclosure 30 may be filled with foam of a thickness T to provide elevation for the conductive element 14*a* above the bottom of the housing 30. Alternatively, conductive material 32 may be first placed in the container and then the tape 14*a* disposed therein during fabrication of the antenna 10.

Figure 6A:
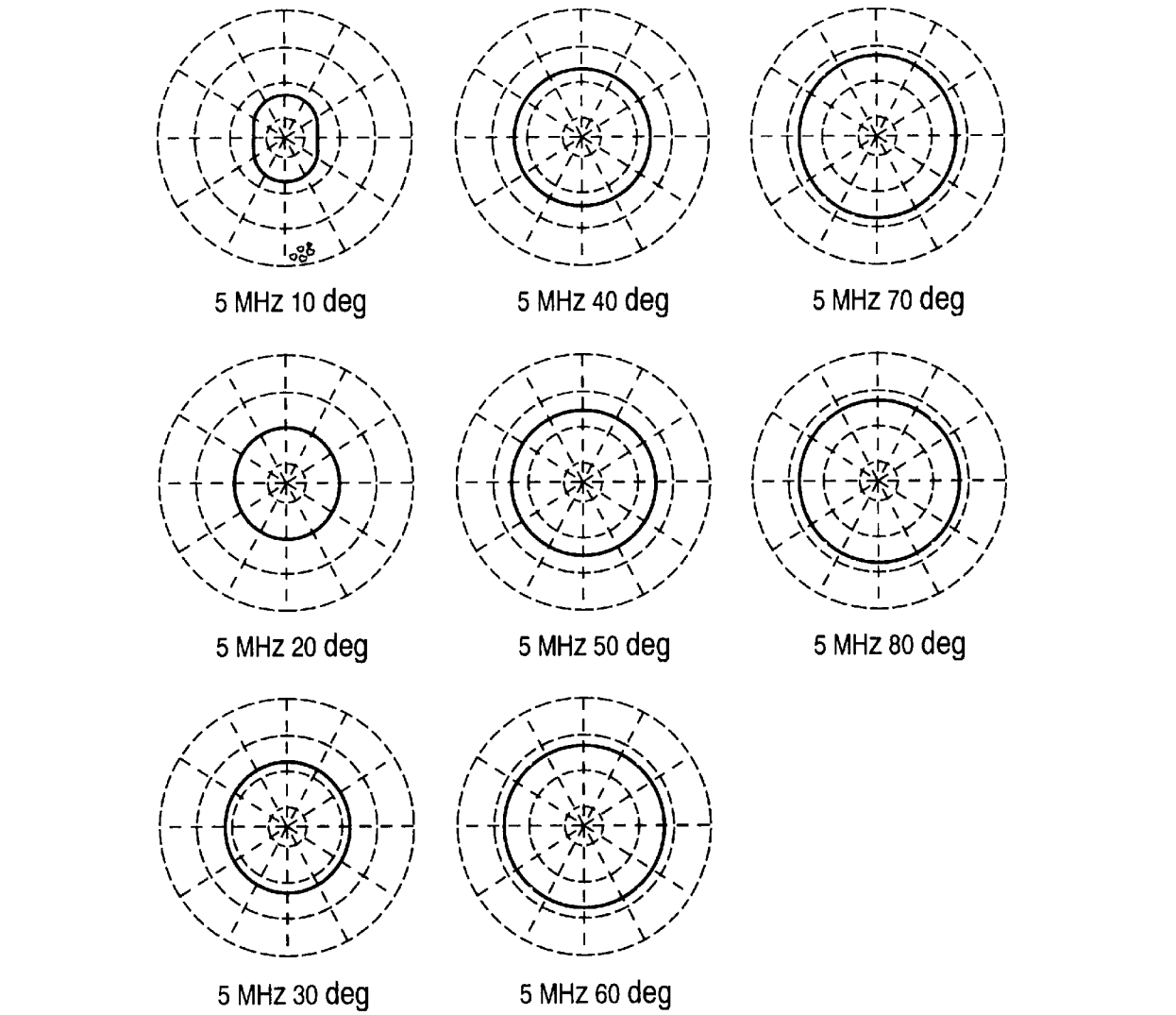
FIGS. 6A, 6B, and 6C are antenna pattern measurements taken at elevation angles of 20, 30, 40, 50, 60, 70, and 80 degrees at radio frequencies of 5, 15 and 25 MegaHertz (MHZ).
Figure 6B:
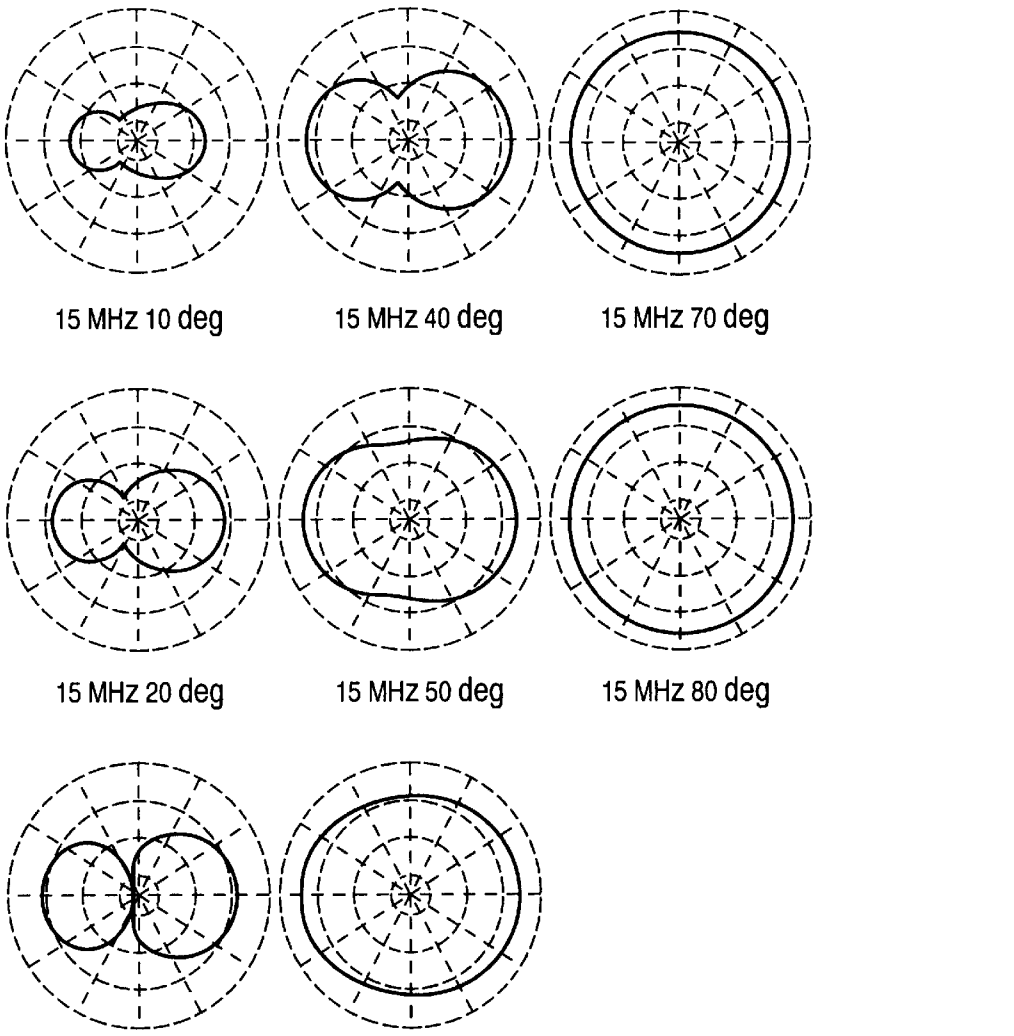
Figure 6C:
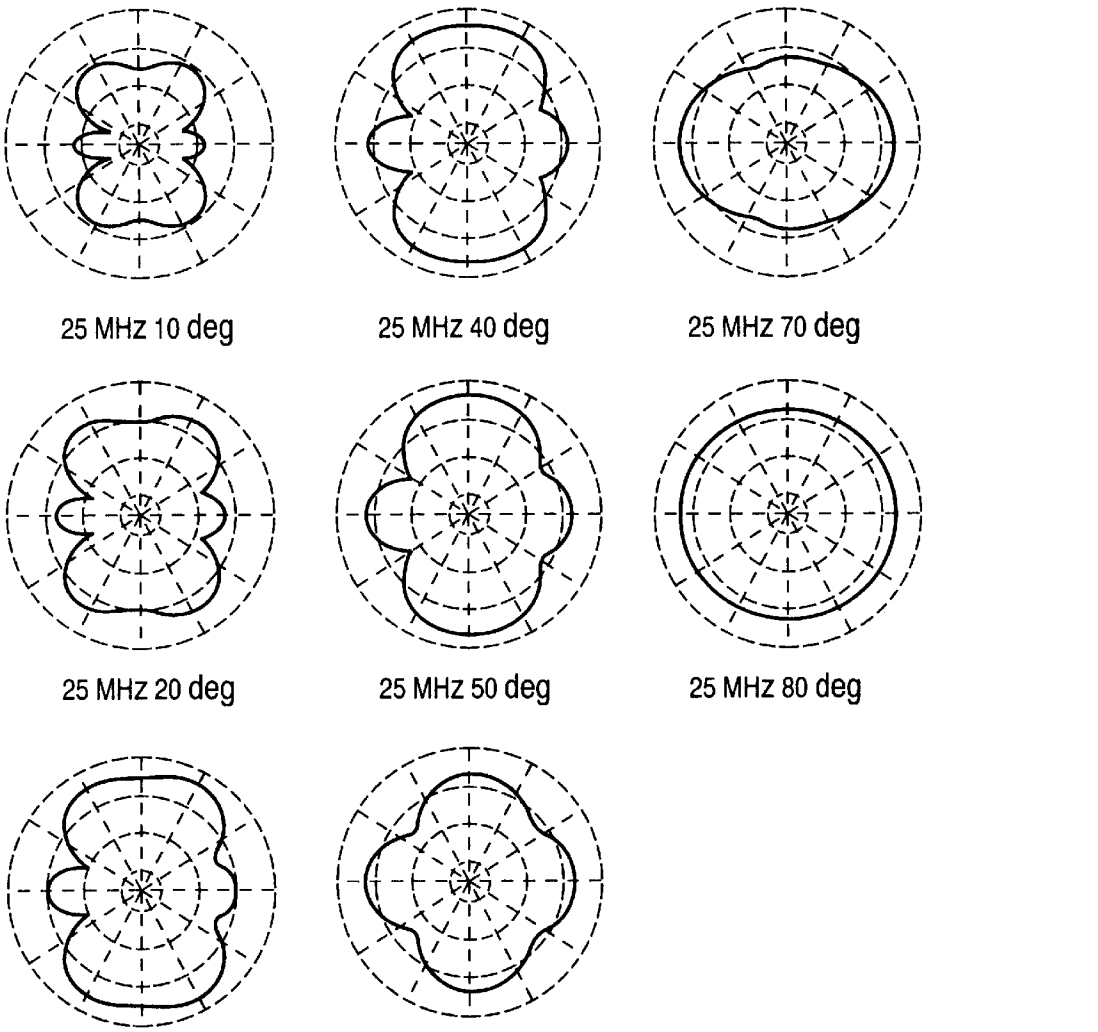

FIGS. 6A, 6B, and 6C show a series of radiation patterns expected to be produced by an antenna 10 according to the invention. In the plots, the major axis of the antenna 10 is oriented along the 0 to 180° axis of the antenna pattern. The plots were taken with the model of a shunt fed antenna located on a 48' long container with the conductive elements being a total of 7' long (3½' long a piece).

FIG. 6A shows a series of plots increasing in elevation angle from 10 to 80° in 10° increments. The plots were taken at a radiating frequency of 5 MHZ. FIGS. 6B and 6C are similar plots taken at radiating frequencies of 15 MHZ and 25 MHZ, respectively.

It can be seen that the antenna response generally becomes more omni-directional as the elevational angle increases in the horizontally polarized case, and that the response becomes more directional (and less uniform) as frequency increases.

It can therefore be seen that we have developed a shunt feed antenna that is particularly adapted for with shipping containers and other vehicles having large conductive substructures. The invention is relatively inexpensive to manufacture and install and contains no moving parts or assemblies. It can be implemented in a rugged configuration suitably durable for application to truck trailers and railway boxcars.

By mounting the shunt feed antenna underneath the container, height and width restrictions for vehicle type containers at highway size limits are avoided. Although the antenna is relatively small with respect to wavelength, it yields relatively higher efficiency as compared whip, patch, or other types of high frequency (HF) antennas that are small relative to wavelength. High efficiency is possible when radiating at high elevation angles towards the sky in the horizontally polarized arrangement. This is because the self-resonant frequency of the portion of the antenna formed by the external surfaces of the container 12 are within the band of operation.

What is claimed is:

1. An apparatus for use with a metallic mobile structure comprising:

two elongated conductive elements, each having a near end and a distal end;

said conductive elements oriented such that the near ends of each element are disposed adjacent one another and the distal ends of each element disposed apart one another;

said conductive elements being disposed adjacent an exterior metallic surface of the mobile structure such that the distal end of each conductive element is shunt fed to the same metallic surface of the mobile structure to provide electrical contact therewith;

wherein the conductive elements excite an electrical current in the exterior surface of said mobile structure; and wherein said electrically excited surface of said mobile structure operates as an antenna.

2. An apparatus as in claim 1 wherein the mobile structure is selected from the group consisting of:

a truck trailer;

a flatbed trailer;

a railcar; or a shipping container.

3. An apparatus as in claim 1 wherein the conductive elements are disposed in the center of the metallic structure.

4. An apparatus as in claim 1 wherein the antenna operates in the High Frequency, HF, radio band and wherein the length of the conductive elements is such that the distance between the distal ends of the conductive elements is approximately seven feet.

5. An apparatus as in claim 1 wherein the antenna operates in the High Frequency, HF, radio band and wherein the length of the conductive elements is such that the distance between the distal ends of the conductive elements is approximately six inches.

6. An apparatus as in claim 1 wherein the conductive elements are disposed beneath a lower planar surface of the metallic structure.

7. An apparatus as in claim 1 wherein the electrical current in the surface of said metallic mobile structure is a closed loop current.

8. An apparatus for use with a metallic mobile structure comprising:

two elongated conductive elements, each having a near end and a distal end;

the conductive elements disposed adjacent an exterior metallic surface of the mobile structure such that the distal end of each conductive element is shunt fed to the same metallic surface of the mobile structure to provide electrical contact therewith;

wherein the conductive elements excite an electrical current in the surface of said mobile structure; and wherein said electrically excited surface of said mobile structure operates as an antenna.

9. An apparatus as in claim 8 wherein the metallic mobile structure is a shipping container.

* * * * *